US009005097B2

(12) United States Patent
Feng et al.

(10) Patent No.: US 9,005,097 B2
(45) Date of Patent: Apr. 14, 2015

(54) VERTICAL CENTRIFUGAL SEPARATOR

(75) Inventors: Qun Ce Feng, Tokyo (JP); Shinichi Fukushiro, Kanagawa (JP)

(73) Assignee: Tomoe Engineering Co., Ltd., Tokyo (JP)

( * ) Notice: Subject to any disclaimer, the term of this patent is extended or adjusted under 35 U.S.C. 154(b) by 893 days.

(21) Appl. No.: 13/146,077

(22) PCT Filed: Jan. 26, 2010

(86) PCT No.: PCT/JP2010/000418
§ 371 (c)(1),
(2), (4) Date: Aug. 24, 2011

(87) PCT Pub. No.: WO2010/084782
PCT Pub. Date: Jul. 29, 2010

(65) Prior Publication Data

US 2011/0301013 A1 Dec. 8, 2011

(30) Foreign Application Priority Data

Jan. 26, 2009 (JP) ..... 2009-014305

(51) Int. Cl.
*B04B 11/08* (2006.01)
*B04B 1/02* (2006.01)
(Continued)

(52) U.S. Cl.
CPC ... *B04B 1/02* (2013.01); *B04B 7/02* (2013.01); *B04B 9/12* (2013.01); *B04B 11/05* (2013.01); *B04B 11/08* (2013.01); *B04B 15/06* (2013.01); *B04B 2011/086* (2013.01)

(58) Field of Classification Search
CPC ..... B04B 11/08; B04B 2011/086; B04B 2011/088
USPC ..... 494/55, 15
See application file for complete search history.

(56) References Cited

U.S. PATENT DOCUMENTS 4,416,655 A * 11/1983 Bennett ..... 494/40
5,743,840 A * 4/1998 Carr ..... 494/13
(Continued)

FOREIGN PATENT DOCUMENTS

CN 1646230 7/2005
JP 53-18060 2/1978
(Continued)

OTHER PUBLICATIONS

International Report on Patentability and Written Opinion of the International Searching Authority issued Aug. 18, 2011 in International (PCT) Application No. PCT/JP2010/000418.
(Continued)

*Primary Examiner* — Charles Cooley
*Assistant Examiner* — Marc C Howell
(74) *Attorney, Agent, or Firm* — Wenderoth, Lind & Ponack, L.L.P.

(57) ABSTRACT

A vertical centrifugal separator includes a casing, a bowl that is rotatably housed in the casing and provided to separate a solution to be processed which is supplied to an interior of the bowl into a liquid and a solid by an action of centrifugal force and discharge the liquid and the solid, and a discharge assembly that is rotatably housed in the bowl and provided to discharge the solid in the bowl. The bowl and the discharge assembly each have an engagement portion that is engaged or disengaged when the bowl and the discharge assembly are moved relative to each other in an axial direction and a position adjustment mechanism for adjusting a phase between the discharge assembly and the bowl relative to a rotation axis, for example, at a single relative position.

10 Claims, 9 Drawing Sheets

(51) Int. Cl.

| | |
|---|---|
| ***B04B 7/02*** | (2006.01) |
| ***B04B 9/12*** | (2006.01) |
| ***B04B 11/05*** | (2006.01) |
| ***B04B 15/06*** | (2006.01) |

(56) References Cited

U.S. PATENT DOCUMENTS

| | | | | |
|---|---|---|---|---|
| 5,908,376 | A * | 6/1999 | Macaluso et al. | 494/29 |
| 6,126,587 | A * | 10/2000 | Berger et al. | 494/55 |
| 2003/0195105 | A1 | 10/2003 | Carr | |
| 2004/0192532 | A1 * | 9/2004 | Mackel et al. | 494/15 |
| 2008/0251436 | A1 * | 10/2008 | Tetsu et al. | 210/145 |

FOREIGN PATENT DOCUMENTS

| | | |
|---|---|---|
| JP | 55-153147 | 11/1980 |
| JP | 8-131894 | 5/1996 |
| JP | 2005-66711 | 3/2005 |
| JP | 2005-522321 | 7/2005 |
| JP | 2007-190493 | 8/2007 |
| WO | 03/086641 | 10/2003 |
| WO | 2007/086114 | 8/2007 |

OTHER PUBLICATIONS

International Search Report issued May 11, 2010 in International (PCT) Application No. PCT/JP2010/000418.

* cited by examiner

VERTICAL CENTRIFUGAL SEPARATOR

BACKGROUND OF THE INVENTION

1. Technical Field

The present invention relates to a centrifugal separator used for centrifugation of various solutions to be processed, and in particular, to a vertical centrifugal separator having a mechanism for automatically discharging solids produced during centrifugal operation.

2. Background Art

Generally, a vertical centrifugal separator includes a casing, a bowl housed rotatably in the casing, and a driving unit such as a motor for driving the bowl. In one known structure, the bowl is supported by, for example, bearings disposed on both the upper and lower sides of the casing (see, for example, Patent Literature 1). Such a vertical centrifugal separator further includes a heavy-liquid discharge portion disposed on the upper side of the casing to discharge a heavy liquid and a light-liquid discharge portion disposed above the heavy-liquid discharge portion to discharge a light liquid. This vertical centrifugal separator is configured such that the bowl is rotated at high speed (for example, 10,000 rpm or higher) during centrifugal operation with the solution to be processed being supplied to the bowl, so that a strong centrifugal force (for example, 20,000 G) is generated to discharge the heavy liquid and the light liquid separated from the solution being processed from the respective discharge portions.

CITATION LIST

Patent Literature

Patent Literature 1: International Publication WO2007/086114

SUMMARY OF INVENTION

Problems to be Solved by the Invention

The above conventional vertical centrifugal separator is not provided with a mechanism for automatically discharging the solids produced during centrifugal operation. Therefore, to remove the solids accumulated in the bowl, for example, the bowl must be detached from the casing after completion of the centrifugation of the solution being processed, and this requires much time and effort.

In particular, when a food or chemical is used as the solution to be processed, the inside of the bowl must be washed as clean as possible after the centrifugation of the solution is processed. In the above conventional vertical centrifugal separator, the bowl is detached from the main body and is then washed. Therefore, the bowl with the solids remaining present in the bowl must be washed, and the time and cost required to complete washing are high.

In view of the above circumstances, the present inventors have attempted to realize automatic discharge of the solids produced. In the course of the development, the inventors have proposed a structure in which a discharge assembly for discharging the solids to the outside of the bowl is disposed in the bowl and the bowl and the discharge assembly are allowed to rotate relative to each other. In the course of the development, the inventors have also proposed a so-called single-end supported structure in which a rotatable body including the bowl and the discharge assembly is rotatably supported at only one side (for example, the upper side) of the casing to increase the volume (diameter) of the bowl and to automatically discharge the solids, for example, rapidly and smoothly.

With such a structure in which the rotatable body supported at only its one side is driven, the dynamic balance between the bowl and the discharge assembly during high-speed rotation is an important factor, and an upset of the dynamic balance may cause vibrations, failure, and the like. Therefore, it is necessary to adjust the relative position (phase) between the bowl and the discharge assembly with respect to the rotation axis to a position that provides the best dynamic balance when the rotatable body rotates at high speed. In addition, it is necessary that the adjustment to the above position can be repeatedly reproduced even after various operations, maintenance, and the like.

Moreover, to perform maintenance, additional interior washing work, and the like, the bowl and other members must be detachable from the main body and in turn disassemblable. Therefore, there is a demand for a structure enabling simple and rapid disassembling work.

The present invention has been proposed to solve the above problems, and a first object of the invention is to provide a vertical centrifugal separator having a mechanism for automatically discharging solids produced during centrifugal processing after the processing.

A second object of the invention is to provide a vertical centrifugal separator having a mechanism in which the dynamic balance between a bowl and a wing portion during high-speed rotation is taken into consideration.

A third object of the invention is to provide a vertical centrifugal separator having a mechanism for automatically washing the bowl without detaching the bowl from the main body after a solution to be processed is centrifuged.

A fourth object of the invention is to provide a vertical centrifugal separator having a structure that enables simple and rapid disassembling work.

Means for Solving the Problems

To solve the foregoing problems, the main structure of a vertical centrifugal separator of the present invention includes: a casing; a bowl serving as a rotatable cylindrical body rotatably housed in the casing, the bowl separating a solution to be processed supplied to the inside of the bowl into a liquid and a solid by the action of centrifugal force, the separated liquid and solid being discharged from respective discharge portions; and a discharge assembly rotatably housed in the bowl, the discharge assembly discharging the separated solid from the bowl. In this configuration, the bowl and the discharge assembly each have an engagement portion being engaged or disengaged when the bowl and the discharge assembly are moved relative to each other in an axial direction and a position adjustment mechanism for adjusting the phase between the discharge assembly and the bowl relative to a rotation axis, and when the solution to be processed is centrifuged, the bowl and the discharge assembly integrally rotate in an engagement state in which the phase adjusted by the position adjustment mechanism is held, and the bowl and the discharge assembly are allowed to rotate relative to each other when the engagement state is released.

In the above configuration, when the solution to be processed is centrifuged, the bowl and the discharge assembly may rotate integrally at high speed while a centrifugal force of about 20,000 G is generated.

The bowl may include a bowl shell having a substantially cylindrical tank shape, to which the solution to be processed is supplied, and a hollow rotation shaft integrated with an upper portion of the bowl shell, and the discharge assembly may include a wing assembly having a plurality of wings formed integrally therewith and contained in the bowl shell and a rotation shaft protruding upward from the wing assembly and rotatably disposed in the hollow rotation shaft of the bowl. The engagement portion may be disposed on the lower side of the bowl and have a tapered portion that is tapered such that the inner diameter of the bowl increases in a downward direction, and the engagement portion of the discharge assembly may be disposed on the lower side of the discharge assembly and have a tapered portion that is tapered such that the width of the discharge assembly increases in the downward direction. When the discharge assembly moves upward relative to the bowl, the engagement state is established in which the bowl driven to rotate rotates integrally with the discharge assembly.

The position adjustment mechanism may include a first ring-shaped member disposed on the rotation shaft of the bowl and a second ring-shaped member disposed on the rotation shaft of the discharge assembly and faces the first ring-shaped member. A groove portion may be formed in one of the ring-shaped members, and a protruding portion fittable to the groove portion may be formed in the other one of the ring-shaped members.

Preferably, the groove portion includes a plurality of groove portions, and the protruding portion includes a plurality of protruding portions. The plurality of groove portions and the plurality of protruding portions are disposed at positions at which each of the protruding portions is fitted to a corresponding one of the groove portions when the rotation shafts are rotated relative to each other. To achieve this configuration, for example, the groove portions and the protruding portions are disposed at the positions arranged such that angles between the positions with respect to the center axis of the rotation shafts are different from each other.

Preferably, the vertical centrifugal separator further includes urging means for urging the discharge assembly in one direction, and the engagement portions are configured to bring the bowl and the discharge assembly into the engagement state by being urged by the urging means after completion of position adjustment by the position adjustment mechanism.

Preferably, in the vertical centrifugal separator, the bowl has a bearing mechanism that includes a plurality of ball bearings arranged in the axial direction, injection holes for lubricating grease that are formed in the ball bearings, and spacers that form spaces for reserving excess grease discharged from the ball bearings when the lubricating grease is fed thereinto, so that the bowl is allowed to rotate at high speed during centrifugation.

Preferably, the vertical centrifugal separator further includes a nozzle for supplying a washing solution to the casing and a sealing mechanism for hermetically sealing the casing so that the bowl, discharge assembly and the inside of the casing are washed in dipping washing. The sealing mechanism preferably has a structure including: a sealing member that is disposed at a connection portion of the casing and is expanded to improve sealing properties when a fluid for pressurization is urged and supplied to the inside of the sealing member; and means for supplying the fluid to the sealing member.

The discharge assembly of the vertical centrifugal separator may include a washing mechanism that includes: a hollow shaft disposed in a portion contained in the bowl; and a spray nozzle disposed so as to be in communication with the hollow shaft. The washing mechanism can wash the discharge assembly and the inside of the bowl by jetting a washing solution urged and supplied from one end of the hollow shaft outward from the spray nozzle. Preferably, the spray nozzle is disposed at a position that allows the washing solution urged and supplied to be jetted toward the discharge assembly and allows the washing solution reflected from the discharge assembly to impinge on an inner wall of the bowl. Washing water used for washing under water sealed conditions may be supplied from the spray nozzle.

The vertical centrifugal separator of the present invention may further include a disassembling mechanism that includes a fixed frame integrated with the casing, an upward-downward movable frame that is movable upward and downward relative to the fixed frame, and a rotationally movable frame to which the bowl is attached, to which the discharge assembly is detachably attached, and which is disposed so as to be rotationally movable relative to the upward-downward movable frame. The disassembling mechanism is configured to cause the upward-downward movable frame to be raised to pull the bowl and the discharge assembly out of the casing, and to cause the rotationally movable frame to rotationally move and then cause the upward-downward movable frame to be lowered, so that the discharge assembly is separated from the rotationally movable frame.

Advantageous Effects of Invention

In the vertical centrifugal separator of the present invention, the solids produced during centrifugation operation can be automatically discharged by releasing the engagement state between the bowl and the discharge assembly after completion of centrifugation of the solution to be processed and then rotating the discharge assembly relative to the bowl. Also, according to the present invention, the position adjustment mechanism for adjusting the phase between the discharge assembly and the bowl relative to the rotation axis to, for example, a single relative position is provided. When the solution to be processed is centrifuged, the discharge assembly and the bowl integrally rotate in an engagement state in which the phase adjusted by the position adjustment mechanism is held. When the engagement state is released, the discharge assembly and the bowl are allowed to rotate relative to each other. Therefore, during, for example, actuation or re-attachment after maintenance, the predetermined positions of the bowl and the discharge assembly that provide dynamic balance during high speed rotation can be reproduced. Accordingly, high speed rotation that provides, for example, a centrifugal force of 20,000 G can be achieved, and vibrations and the like are suppressed, so that the rotational movement is stabilized.

In the vertical centrifugal separator having the washing mechanism of the present invention, the inside of the bowl can be automatically washed after the centrifugation of the solution being processed. By setting the position of the spray nozzle to a position that allows the urged and supplied washing solution to be jetted toward the discharge assembly and allows the washing solution reflected from the discharge assembly to impinge on the inner wall of the bowl, the discharge assembly and the bowl can be washed simultaneously.

In the vertical centrifugal separator having the disassemblable structure of the present invention, the fixed frame and the casing are integrated, and the upward-downward movable frame that moves upward and downward relative to the fixed frame is provided. In addition, the rotatably movable frame is provided so as to be rotatably movable relative to the upward-downward movable frame, and the bowl is provided so as to be rotatably movable relative to the rotatably movable frame. Therefore, when the upward-downward movable frame is raised, the rotatably movable frame and the bowl are integrally raised, and the bowl can thereby be pulled upward out of the casing. In addition, the rotational movement of the rotatably movable frame allows the bowl poisoned above the casing to be separated from the casing.

DETAILED DESCRIPTION OF THE INVENTION

First Embodiment

A first embodiment of the present invention will be described in detail with reference to the drawings.

Figure 1:
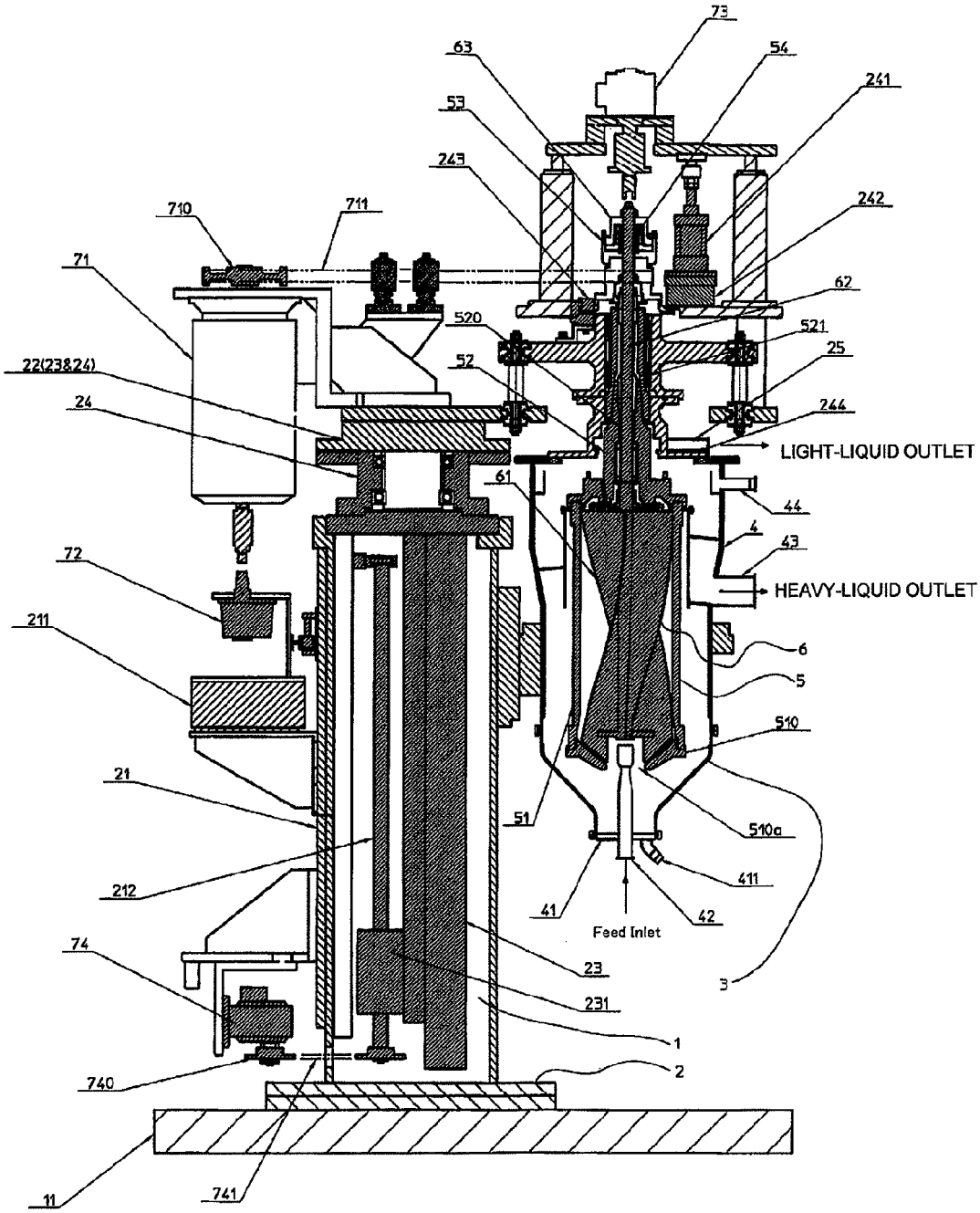
FIG. 1 is a partial cross sectional view illustrating the general outline of a vertical centrifugal separator to which a first embodiment of the present invention is applied.

As shown in FIG. 1, a vertical centrifugal separator 1 of the present embodiment has a structure in which a vertical centrifugal separator main body 3 is attached to a frame 2 placed on a base (floor surface) 11.

The frame 2 includes: a fixed frame 21 that is placed on and secured to the base 11 and to which a casing 4 of the centrifugal separator main body 3 is secured; and a movable frame 22 that is movable relative to the fixed frame 21. The movable frame 22 includes: an upward-downward movable frame 23 disposed so as to be capable of being raised and lowered, i.e., to be movable upward and downward, relative to the fixed frame 21; and a rotatably movable frame 24 disposed so as to be rotatably movable relative to the upward-downward movable frame 23.

The fixed frame 21 has a hollow structure with a substantially prism shape and contains the upward-downward movable frame 23 thereinside in an upward-downward movable manner. The lower portion of the upward-downward movable frame 23 has a column shape and is moved upward and downward in the space inside the fixed frame 21 by a raising-lowering mechanism disposed inside the fixed frame 21, which will be described later. The upper portion of the upward-downward movable frame 23 has a substantially circular shape in a plan view and is connected to the rotatably movable frame 24 through a support portion (not shown) that rotatably supports the rotatably movable frame 24.

The rotatably movable frame 24 is detachably connected at its one end side to the upper portion of the casing 4 of the centrifugal separator main body 3 described later, and a main driving motor 71 is disposed on the other end side of the rotatably movable frame 24. The substantially central portion of the rotatably movable frame 24, i.e., a portion near its center of gravity, has a substantially circular shape in a plan view and serves as a connection portion rotatably connected to the support portion of the fixed frame 21 described above.

A first cylinder 241 for moving a wing driving motor 73 upward and downward relative to the rotatably movable frame 24, a second cylinder 242 that is connected to the lower portion of the first cylinder 241 and provided to move upward and downward the position of a wing portion 6 used as a discharge assembly described later, and a brake 243 that abuts against the upper portion of a rotation shaft 52 of a bowl 5 described later to stop the rotation of the bowl 5 are further disposed on the one end side of the rotatably movable frame 24. These cylinders 241 and 242 and the brake 243 are driven by actuators not shown.

A plurality of motors serving as driving means are disposed on the frame 2. In the present embodiment, four motors are provided, which include the main driving motor 71 actuated during centrifugation of a solution being processed, a low-speed driving motor 72 actuated during washing of the centrifugal separator main body 3, the wing driving motor 73 actuated during position adjustment of the bowl 5 and the wing portion 6 described later and during the operation for discharging solids produced during centrifugation, and a bowl removing motor 74 actuated during the operation for disassembling the bowl & wing assembly of the centrifugal separator.

Among these motors, the main driving motor 71 is attached to the rotatably movable frame 24, and the driving shaft of the motor 71 protrudes from the upper and lower ends of the body of the motor. A pulley 710 is attached to the upper side of the driving shaft of the main driving motor 71, and its driving force is transmitted to the bowl 5 through a driving belt 711 wound around the pulley 710. The lower portion of the driving shaft of the main driving motor 71 faces the driving shaft of the low-speed driving motor 72, and the end of the driving shaft of the main driving motor 71 has a shape fittable to the shape of the end of the driving shaft of the low-speed driving motor 72.

The low-speed driving motor 72 is attached to the fixed frame 21 below the main driving motor 71 such that the driving shaft of the low-speed driving motor 72 is positioned coaxially with the driving shaft of the main driving motor 71. The end of the driving shaft of the low-speed driving motor 72 has a shape fittable to the end of the driving shaft of the main driving motor 71. The low-speed driving motor 72 is attached to a lifter 211 that moves upward and downward along the side surface of the fixed frame 21. When the lifter 211 in the state shown in FIG. 1 is moved upward by a not-shown actuator, the end of the driving shaft of the low-speed driving motor 72 is fitted to the end of the driving shaft of the main driving motor 71, and these driving shafts are thereby coupled to each other. In this coupled state, when the low-speed driving motor 72 is driven to rotate, the driving force is transmitted to the bowl 5 through the driving shaft of the main driving motor 71, the driving belt 711, and the like.

The wing driving motor 73 is attached above the rotatably movable frame 24 through the first cylinder 241 and the second cylinder 242 such that the driving shaft of the wing driving motor 73 is positioned coaxially with a rotation shaft 62 of the wing portion 6 described later. The driving shaft of the wing driving motor 73 faces the upper end of the rotation shaft 62 of the wing portion 6, and the end of the driving shaft of the motor 73 has a shape fittable to the upper end of the rotation shaft 62 of the wing portion 6.

The bowl removing motor 74 transmits its driving force to the rotation shaft 212 of the raising-lowering mechanism provided inside the fixed frame 21 through a driving chain 741 and is disposed at the lower portion of the fixed frame 21 with the driving shaft of the motor 74 extending downward. A sprocket 740 engaging the driving chain 741 is provided to the driving shaft.

Next, a description will be giving of the raising-lowering mechanism for raising-lowering, i.e., moving upward and downward, the upward-downward movable frame 23. The raising-lowering mechanism is configured to include the rotation shaft 212, a protruding portion 231 protruding from the lower portion of the upward-downward movable frame 23 and attached to the rotation shaft 212, and the bowl removing motor 74 for driving and rotating the rotation shaft 212.

The rotation shaft 212 is a substantially cylindrical member, is disposed vertically inside the fixed frame 21, and is rotationally supported inside the fixed frame 21 by a not-shown bearing and the like. The rotation shaft 212 has a not-shown thread groove portion formed on its surface and is driven to rotate by the bowl removing motor 74 through the driving chain 741. A not-shown thread hole into which the thread groove portion of the rotation shaft 212 is screwed is formed also in the protruding portion 231 of the upward-downward movable frame 23, and the protruding portion 231 is thereby installed to the rotation shaft 212. Therefore, when the bowl removing motor 74 drives the rotation shaft 212 to rotate in a forward/backward direction, the upward-downward movable frame 23 integrated with the protruding portion 231 attached to the rotation shaft 212 moves upward/downward.

The centrifugal separator main body 3 includes the substantially cylindrical casing 4 connected integrally to the fixed frame 21, the bowl 5 rotatably contained in the casing 4, and the wing portion 6 rotatably contained in the bowl 5 and serving as a discharge assembly for discharging solids in the bowl 5.

The casing 4 has a substantially cylindrical outer shape as a whole, and the bottom side of this shape is narrowed, so that a container-like (tank-like) inner shape is formed. The casing 4 is connected at its one end side to the fixed frame 21 by not-shown tightening bolts and the like, and a heavy-liquid discharge port 43 described later is provided at the other end side. A outlet 44 for an overflow is provided on the upper end side of the casing 4. The outlet 44 can be used to allow a washing solution to overflow when, for example, the inside of the casing 4 is washed in dipping washing.

A detachable cover member 41 having a substantially circular shape in a plan view is attached to the lower portion of the casing 4, and a feed tube 42 for supplying the solution to be processed and the washing solution is disposed at the center of the cover 41. A drain port 411 for discharging the washing solution, which will be described later, used for washing and scrap materials and the like (such as residues of the processed solution) in the bowl 5 is provided near the feed tube 42. The heavy-liquid discharge port 43 for discharging a heavy liquid produced and separated when the solution to be processed is centrifuged is disposed on the upper side of the casing 4 so as to protrude toward the outside of the casing 4.

The one end side of the rotatably movable frame 24 is detachably disposed on the upper surface of the casing 4. More specifically, a lower portion of main bearing housing 244 for covering the top portion of the casing 4 is formed on the one end side of the rotatably movable frame 24. The lower portion of main bearing housing 244 has a substantially circular disc shape with an outer diameter greater than the outer diameter of the bowl 5. A light-liquid discharge outlet 25 for discharging a light liquid produced and separated when the solution to be processed is centrifuged is provided in the lower portion of main bearing housing 244 so as to be in communication with the upper portion of the bowl 5. In the present embodiment, the casing 4 is secured to the fixed frame 21, and the rotatably movable frame 24 moves upward and downward together with the raising-lowering movement of the upward-downward movable frame 23. Therefore, when the rotatably movable frame 24 moves upward, the bowl 5 and the wing portion 6 move upward and are thereby pulled out of the casing 4.

The bowl 5 includes a bowl shell 51 to which the solution to be processed is supplied and the rotation shaft 52 provided integrally above the bowl shell 51 and rotatably supported by the rotatably movable frame 24.

Figure 2:
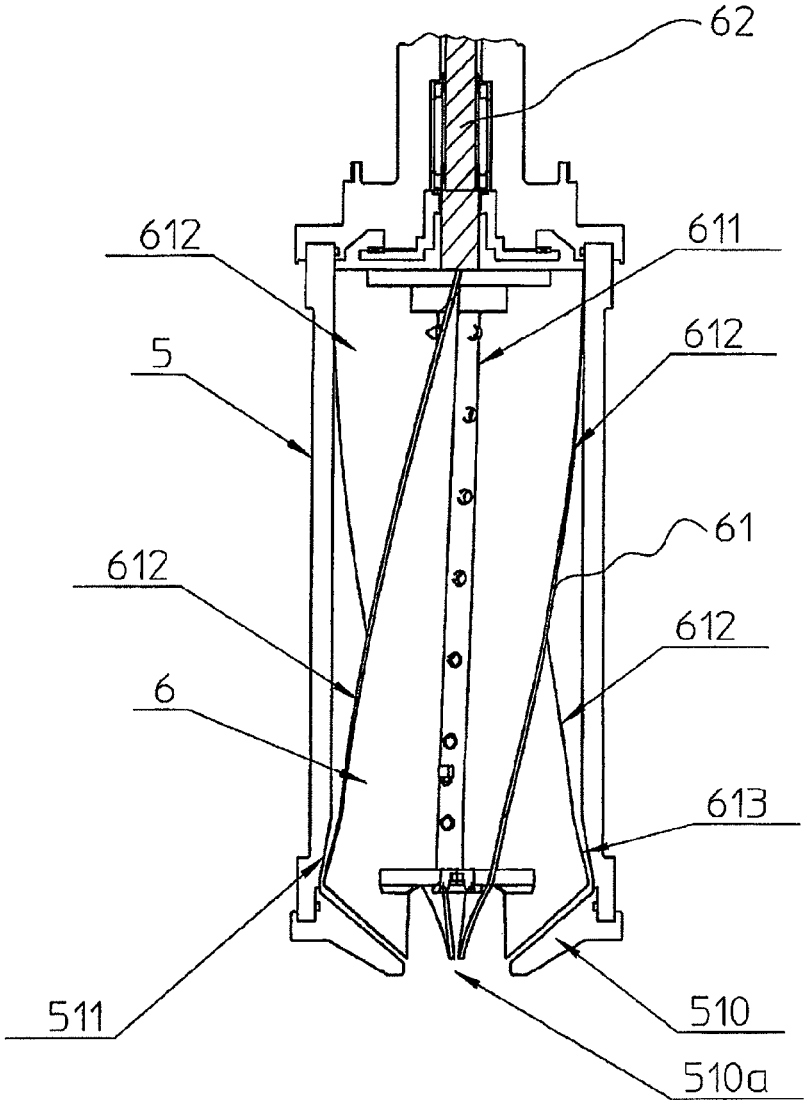
FIG. 2 is a diagram illustrating the structure of a bowl and a wing portion.

The bowl shell 51 has a substantially cylindrical tank-like shape smaller than the casing 4, and a bowl bottom 510 is detachably attached to the bottom of the bowl shell 51 by not-shown securing means such as bolts. The bowl bottom 510 has a substantially annular shape in a plan view. The feed tube 42 described above is inserted into the center of the bowl bottom 510, and a substantially circular hole **510*a* for discharging the solids (a cake) in the bowl 5 is formed at the center of the bowl bottom 510. The bowl bottom 510 has a cross sectional shape inclined toward the hole 510*a* as shown in FIG. 2 to facilitate a function of the bowl bottom 510, i.e., the discharge of the solids (cake) in the bowl 5. The rotation shaft 52 for driving the bowl shell 51 to rotate is provided integrally at the upper portion of the bowl 5. The rotation shaft 52 of the bowl 5 is rotatably supported on the one end side of the rotatably movable frame 24 through a bearing mechanism 521 such as bearings. A hollow rotation support portion 520 is formed in the central portion of the rotation shaft 52 of the bowl 5 to rotatably support the wing portion 6**.

Figure 3:
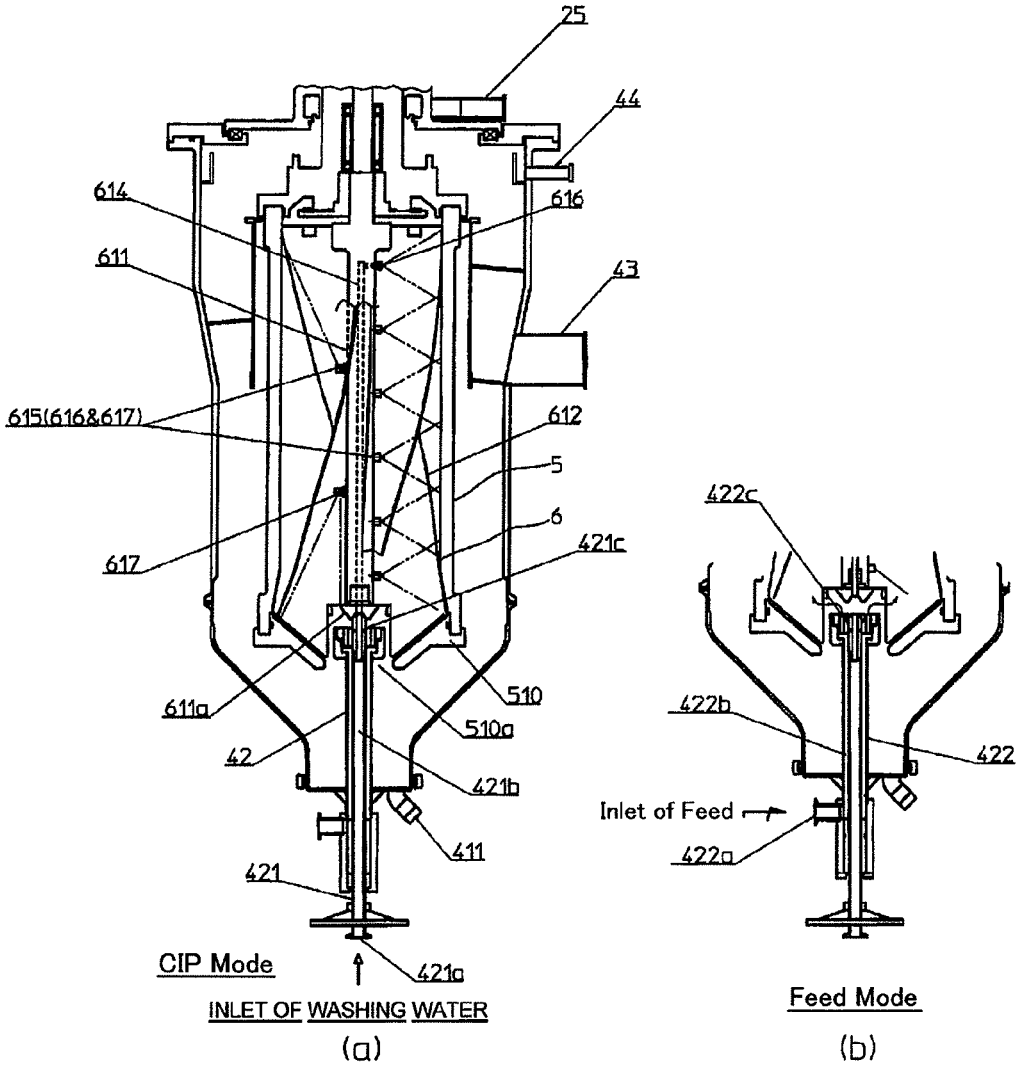
FIG. 3 is a set of diagrams illustrating the states during washing and during separation of a solution being processed, FIG. 3(*a*) showing the state during washing, FIG. 3(*b*) showing the operation state during separation of the solution to being processed.

As shown in FIGS. 2 and 3, the wing portion 6 includes: a wing assembly 61 having a structure in which a plurality of plate-shaped wings 612 are formed so as to protrude from a shaft 611 serving as a rotation center; and the rotation shaft 62 that is disposed coaxially with the shaft 611 and protrudes upward from the wing assembly 61. In the present embodiment, four wings 612 having the same shape are provided such that adjacent wings form an angle of 90°, and the outer portion of each wing has a shape twisted in a clockwise direction in a plan view. When the rotation shaft 62 of the wing portion 6 is inserted into the rotation support portion 520 in the rotation shaft 52 of the bowl 5 described above, the entire wing portion 6 is supported rotatably relative to the bowl 5 and the rotatably movable frame 24.

The wings 612 of the wing portion 6 form an outer shape having a diameter slightly smaller than the inner diameter of the bowl 5 so that the wings 612 can rotate inside the bowl 5 relative to the bowl 5. In the present embodiment, to allow the wing portion 6 and the bowl 5 coupled to each other to rotate integrally, an engagement portion is formed on the lower side of the wing portion 6, and also an engagement portion is formed on the lower side of the bowl 5. These engagement portions will next be described in detail.

In the vertical centrifugal separator 1, the bowl 5 and the wing portion 6 have their respective engagement portions that are engaged/disengaged when the bowl 5 and the wing portion 6 are relatively moved in an axial direction, i.e., an upward/downward direction. In the present embodiment, as shown in FIGS. 2 and 3, a tapered portion 511 formed such that its inner diameter increases toward the end of the bowl 5, i.e., in a downward direction, is provided in the lower portion of the inner wall of the bowl 5. Each of the four wings 612 of the wing portion 6 has a tapered portion 613 formed in its outer lower portion and shaped such that the outer radial width of each wing 612 increases toward the end of the bowl 5, i.e., in the downward direction. The tapered portion 613 of each wing 612 has a shape that substantially conforms to the shape of the tapered portion 511 of the bowl 5. More specifically, the diameter of the outer shape formed by the outer lower portions of the wings 612 is slightly smaller than the diameter of the tapered portion 511 of the bowl 5 when the wing assembly 61 is located at the lowermost position, and therefore the wings 612 do not interfere with the inner wall of the bowl 5. When the wing portion 6 moves upward, the tapered portion 613 of each of the wings 612 abuts against the tapered portion 511 of the bowl 5. Then each of the wings 612 is engaged with the inner wall of the bowl 5, so that the bowl 5 and the wing portion 6 are temporarily coupled to each other. In the vertical centrifugal separator 1 provided with such engagement portions, when the wing portion 6 is pulled upward, the bowl 5 and the wing portion 6 are engaged with each other, and these members (5 and 6) are secured to each other during the centrifugal operation for the solution to be processed and are allowed to rotate integrally at high speed.

Referring next to FIG. 3, the structure for washing the inside of the bowl 5 will be described. As shown in FIG. 3, the feed tube 42 has a double tube structure in which a outer tube 422 for the liquid feeding is disposed outside of the inner tube 421 for the washing feeding. As shown in FIG. 3(*b*) when the centrifugal operation is in feed mode, the liquid is supplied by feed port 422*a* and jetted from nozzle 422*c* through a space 422*b* between outer tube 422 and inner tube 421. The washing solution is supplied by supply port 421*a* and jetted from a nozzle 421*c* through an inner tube 421 when the centrifuge operation is in CIP mode.

An inner tube 614 for the passage of the washing solution is provided in the shaft 611 of the wing portion 6. The inner tube 614 is formed so as to extend from the lower end side of the shaft 611 of the wing assembly 61 to its upper portion side. The lower end side of the shaft 611 in communication with the inner tube 614 is connected to or disposed near the washing solution spray nozzle 421*c* of the feed tube 42 and serves as a connection portion 611*a* having a recessed shape corresponding to the outer shape of the washing solution spray nozzle 421*c*. As shown in FIG. 3, each wing 612 of the wing portion 6 is cut near the connection portion 611*a* to form a substantially "L"-shaped notch so that the wing 612 does not interfere with the end of the feed tube 42.

In the wing assembly 61 of the wing portion 6, a plurality of nozzles 615 are disposed on the shaft 611 so as to be in communication with the inner tube 614. The nozzles 615 include: horizontal spray nozzle 616 for jetting the washing solution in a lateral direction, i.e., toward the outer side of the wings 612, at high pressure; and vertical spray nozzle 617 for jetting the washing solution in a longitudinal direction, i.e., toward the upper and lower sides of the wings 612, at high pressure. The horizontal spray nozzle 616 and the vertical spray nozzle 617 are disposed such that the washing solution jetted therefrom is directed to one side of each wing. The jetting port of each of the horizontal spray nozzle 616 and the vertical spray nozzle 617 has a flattened shape so that the supplied washing solution is jetted so as to be spread in a planar fashion.

A plurality of horizontal spray nozzles 616 (for example, 6 nozzles for each wing) is disposed on the shaft 611 of the wing assembly 61 at predetermined intervals. Preferably, the horizontal spray nozzles 616 are disposed at intervals that cause the washing solution jetted from one nozzle and the washing solution jetted from another nozzle to overlap slightly as shown in FIG. 3(*a*). The vertical spray nozzles 617 are disposed on the shaft 611 of the wing assembly 61 such that one nozzle is oriented toward the upper side of one wing and another nozzle is oriented toward the lower side of the one wing (i.e., two nozzles are provided for one wing). The vertical spray nozzles 617 are disposed at positions at which the jetting direction of the washing solution does not interfere with the emission directions of the washing solution jetted from the horizontal spray nozzles 616.

In the present embodiment, the horizontal spray nozzles 616 and the vertical spray nozzles 617 are disposed on the shaft 611 such that one row of nozzles 616 and one row of nozzles 617 are provided for each wing. More specifically, since four wings 612 are provided for the structure in the present embodiment, four rows of horizontal spray nozzles 616 and four rows of vertical spray nozzles 617 (a total of 32 nozzles) are disposed.

When the feed liquid is supplied through the feed tube 42, this solution is jetted so as to be spread outward by the inclined surface of the connection portion 611*a* as shown in FIG. 3(*b*) and is then supplied to the bowl 5. When the washing solution urged at a predetermined pressure is supplied to the feed tube 42 during washing, the washing solution flows upward from one end side of the inner tube 614 of the shaft 611 of the wing portion 6 as shown in FIG. 3(*a*) and then jetted from the nozzles 616 and 617 in communication with the inner tube 614 at high pressure. During washing, the washing solution jetted from the nozzles 616 and 617 impinges strongly on the near-outer edge portion of each wing 612 at a predetermined angle, is then reflected from the each wing 612, and impinges on the inner wall of the bowl 5.

No particular limitation is imposed on the type and number of the horizontal spray nozzle 616 and the vertical spray nozzle 617, and the type and the number may be appropriately changed according to the jetting direction of the washing solution from each nozzle (the spreading angle), the size of each wing, and other factors. It is not always necessary to provide both the horizontal spray nozzle 616 and the vertical spray nozzle 617.

The vertical centrifugal separator 1 further includes a position adjustment mechanism for adjusting the phase between the wing portion 6 and the bowl 5 relative to the rotation axis to, for example, a single relative position relative to the rotation axis. The position adjustment mechanism is configured to include a plurality of groove portions and a plurality of protruding portions fittable to the groove portions, the groove portions and protruding portions being formed on the upper sides of the rotation shafts 62 and 52 of the wing portion 6 and the bowl 5, respectively. When the rotation shafts 62 and 52 are rotated relative to each other, the fittable protruding portions are fitted into the corresponding groove portions, and the adjustment of the positions of the wing portion 6 and the bowl 5 relative to the rotation axis to the single relative position are thereby achieved. The position adjustment mechanism will next be described with reference to FIG. 4.

In the present embodiment, the position adjustment mechanism includes an index ring 53 secured to the upper end of the rotation shaft 52 of the bowl 5 and an inner ring 63 disposed on the wing portion 6 and fittable to the index ring 53. The protruding portions are formed in the index ring 53, and the groove portions are formed in the inner ring 63.

Figure 4:
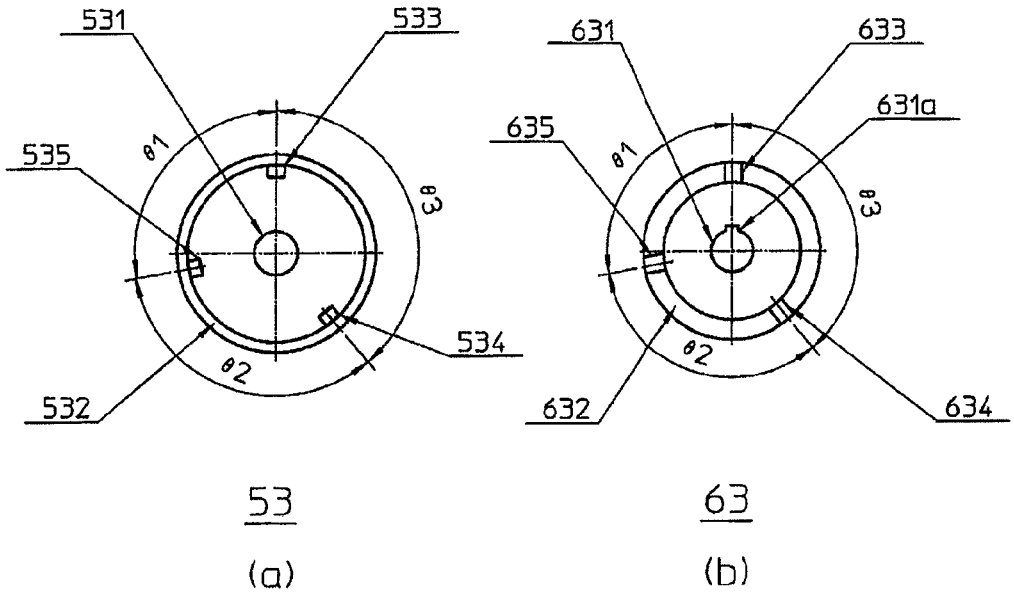
FIG. 4 is a set of diagrams illustrating a position adjustment mechanism, FIG. 4(*a*) being a plan view of an index ring on the bowl side, FIG. 4(*b*) being a plan view of an inner ring on the wing portion side.

The index ring 53 has a substantially annular shape in a plan view. A circular hole 531 in a plan view for inserting the rotation shaft 62 of the wing portion 6 is formed at the center of the index ring 53, and a ring-shaped standing wall portion 532 in a plan view for inserting the side surface of the inner ring 63 is formed outside the hole 531. As shown in FIG. 4(*a*), a plurality of protruding portions 533, 534, and 535 (at three positions in the present embodiment) are provided along the inner surface of the standing wall portion 532 of the index ring 53. The angles between lines connecting the centers of the protruding portions to the center axis of the rotation shaft 62 (θ1, θ2, θ3) are different from each other. For example, these different angles are 100°, 120°, and 140°.

The inner ring 63 fittable to the index ring 53 is detachably attached near the upper end of the rotation shaft 62 of the wing portion 6. The inner ring 63 has a substantially annular shape in a plan view with an outer diameter slightly smaller than the inner diameter of the index ring 53, and a substantially circular hole 631 in a plan view for inserting the rotation shaft 62 of the wing portion 6 is formed at the center of the inner ring 63. A notch 631*a* for inserting a position adjustment projection (not shown) provided on the rotation shaft 62 of the wing portion 6 is provided in the hole 631. The inner ring 63 has a flange portion 632 formed at one end, so that the lower portion of the inner ring 63 that faces the index ring 53 is formed to protrude outward. Groove portions 633, 634, and 635 (three groove portions in the present embodiment), the number of which are the same as the number of the protruding portions 533, 534, and 535 of the index ring 53, are formed in the flange portion 632 of the inner ring 63 at positions corresponding to the protruding portions. More specifically, the angles between lines connecting the centers of the groove portions 633, 634, and 635 to the center axis of the rotation shaft 62 are the same as the different angles between the protruding portions 533, 534, and 535, i.e., are 100°, 120°, and 140° in this example.

A coil spring 54 serving as urging means for urging the inner ring 63 and, in turn, the entire wing portion 6 upward is disposed between the index ring 53 and the inner ring 63 with the rotation shaft 62 of the wing portion 6 inserted into the coil spring 54.

In the present embodiment configured as described above, when the inner ring 63 is stopped, the index ring 53 is rotated the rotation shaft 62 of the wing portion 6 while a force against the spring force of the coil spring 54 is applied to press the inner ring 63 toward the index ring 53, the protruding portions 533, 534, and 535 of the index ring 53 are fitted into the groove portions 633, 634, and 635 of the inner ring 63, respectively. Then the index ring 53 on the bowl 5 is engaged with the inner ring 63 on the wing portion 6, and the positions of the bowl 5 and the wing portion 6 relative to the rotation shaft 62 are thereby adjusted to the single relative position.

Therefore, in the vertical centrifugal separator 1, when the operation for centrifugation is started or detached members are re-attached after maintenance, the predetermined relative position between the bowl 5 and the wing portion 6 with respect to the rotation axis can be reproduced so that the dynamic balance during high-speed rotation is ensured. More specifically, when the bowl 5 and the wing portion 6 are rotated integrally during centrifugation and are rotated relative to each other during discharge of the cake and during washing as in the present embodiment, the positional relation between the bowl 5 and the wing portion 6 relative to the rotation axis when the relative rotation is stopped is not always the same as that when the bowl 5 and the wing portion 6 are rotated integrally. When high-speed rotation is performed, a slight imbalance due to, for example, production errors may cause vibrations, which may hinder stable high-speed rotation. Therefore, for example, the phase that minimizes vibrations is determined in advance by tests and the like. By adjusting the positions of the bowl 5 and the wing portion 6 always to positions giving the determined phase when the bowl 5 and the wing portion 6 are rotated integrally, the position adjustment in consideration of dynamic balance is achieved. In the above configuration, the spring that urges the index ring 53 and the inner ring 63 against each other is interposed therebetween. Therefore, when the force that presses the inner ring 63 toward the index ring 53 is released, the bowl 5 and the wing portion 6 are engaged with each other at the above-described engagement portions provided in the bowl 5 and the wing portion 6 while the predetermined positions of the bowl 5 and the wing portion 6 relative to the rotation axis are maintained. This can maintain the adjusted phase.

In the present invention, it is sufficient that the position adjustment mechanism is configured such that the positions of the wing portion 6 and the bowl 5 relative to the rotation axis can be adjusted to a single relative position that gives the best dynamic balance. However, the number of the single relative position is not necessarily one. A plurality of relative positions may be used so long as the dynamic balance is within an allowable range. In the present embodiment, the ring-shaped member having protruding portions is provided on the bowl 5, and the ring-shaped member having groove portions fittable to the protruding portions is provided on the wing portion 6. However, in contrast to the above configuration, groove portions may be provided for the bowl 5, and protruding portions fittable to the groove portions may be provided for the wing portion 6.

In the present embodiment, the numbers of the groove portions and protruding portions are 3. However, no particular limitation is imposed on these numbers. To allow the relative position between the wing portion 6 and the bowl 5 with respect to the rotation axis to be adjusted to a single relative position, it is preferable that, when a plurality of groove portions and projections are provided, the angles between adjacent groove portions and protruding portions with respect to the rotation axis be set to be different from each other, as described above. If the groove portions and protruding portions are disposed such that the angles between adjacent groove portions and protruding portions with respect to the rotation axis are the same, for example, three groove portions and three protruding portions are disposed at 120° intervals relative to the central axis, the effect described above can be obtained by arranging the groove portions and protruding portions such that the distances of the positions (phases) of the groove portions and protruding portions from the rotation axis are different from each other.

The operations of the vertical centrifugal separator 1 will next be described.

(Feed Mode)

First, the basic operation of the vertical centrifugal separator 1 during centrifugation of the solution to be processed will be described. In the state shown in FIG. 1, the relative position of the entire wing portion 6 is raised by the urging force of the coil spring 54, and the bowl 5 is engaged with the wing portion 6. In the state shown in the figure, a not-shown actuator is driven to lower the first cylinder 241. During this operation, the wing driving motor 73 is moved downward, and the driving shaft of the wing driving motor 73 is coupled to the rotation shaft 62 of the wing portion 6. Next, a not-shown actuator is driven to lower the second cylinder 242. During this operation, each of the wings 612 coupled to the tapered portion 511 in the lower portion of the bowl 5 is moved downward against the spring force of the coil spring 54. Then the lower portion of the wing portion 6 is released from the bowl 5, and the coupling between the wing portion 6 and the bowl 5 is thereby released.

Next, a not-shown actuator is driven to bring the brake 243 to an ON state, i.e., into abutment against the rotation shaft 52 of the bowl 5. During this operation, the bowl 5 is secured to the rotatably movable frame 24 and to the casing 4. When the wing driving motor 73 is driven while the bowl 5 is in the secured state, the entire wing portion 6 is rotated. Then the protruding portions 533, 534, and 535 of the index ring 53 in the above position adjustment mechanism are inserted into the groove portions 633, 634, and 635 of the inner ring 63, respectively, and the inner ring 63 and the index ring 53 are engaged with each other at a predetermined position. The positions (phases) of the wing portion 6 and the bowl 5 relative to the axis are set to positions that allow high speed rotation while dynamic balance is taken into consideration.

Next, not-shown actuators are driven to raise the first cylinder 241 and the second cylinder 242. During this operation, the entire wing portion 6 is moved upward by the urging force of the coil spring 54. Then the tapered portion 511 of the bowl 5 and the tapered portions 613 of the wing portion 6 abut against each other and are engaged with each other, so that the wing portion 6 and the bowl 5 are secured to each other. In this case, the inner ring 63 is separated from the index ring 53. However, the tapered portions 613 of the wing portion 6 and the tapered portion 511 of the bowl 5 are engaged with each other at positions that are set by the position adjustment mechanism described above and allow high speed rotation, and the bowl 5 and the wing portion 6 are allowed to rotate integrally.

Next, in the above state, the main driving motor 71 is driven. After the rotation speed of the motor 71 reaches a predetermined value, the solution to be processed is supplied from the feed tube 42 to the bowl 5. During this operation, the wing portion 6 and the bowl 5 rotates integrally at high speed, and the solid-liquid separation of the supplied solution to be processed is started. Hereinafter, the bowl 5 and the wing portion 6 are collectively referred to as a "rotatable cylindrical body." During high speed rotation, the rotation speed and centrifugal force of the rotatable cylindrical body are about 10,000 rpm and 20,000 G (twenty thousand G). However, the bowl 5 and the wing portion 6 are rotated integrally at the position in which the phase between them is set with the dynamic balance being taken into consideration, as described above. Therefore, in the vertical centrifugal separator 1 of the present embodiment, as the rotation speed of the rotatable cylindrical body increases, the stable center of the rotation is established, so that vibrations generated during centrifugation can be reduced although the vertical centrifugal separator 1 has the single-end supported structure. In addition, in the vertical centrifugal separator 1 of the present embodiment, the diameter of the bowl can be increased relative to that in a vertical centrifugal separator having a conventional both-end supported structure in which the vibrations generated during centrifugation are absorbed by upper and lower bearings.

Accordingly, in the vertical centrifugal separator 1, when the solution to be processed is centrifuged, a light liquid separated by the action of very strong centrifugal force is discharged from the uppermost light-liquid discharge outlet 25, and a heavy liquid is discharged from the lower heavy-liquid discharge port 43. The separated solids (cake) are accumulated in the rotatable cylindrical body.

When a predetermined amount of solids (for example, about 40 L) is accumulated in the bowl assembly, the supply of the solution to be processed is stopped. Then the operation of the main driving motor 71 is stopped to stop the rotation of the rotatable cylindrical body, and the solid-liquid separation operation is thereby ended.

A description will next be given of the operation during discharge of the solids accumulated in the rotatable cylindrical body and other operations. In the state in which the rotatably cylinder is stopped as described above, a not-shown actuator is driven to lower the first cylinder 241. During this operation, the driving shaft of the wing driving motor 73 is coupled to the rotation shaft 62 of the wing portion 6.

Next, a not-shown actuator is driven to lower the second cylinder 242. Then the wing portion 6 is lowered, and the wings 612 are thereby released from the bowl 5, so that the engagement state between the bowl 5 and the wing portion 6 is released.

Next, the cover 41 provided with the feed tube 42 is detached from the casing 4. The solids accumulated in the rotatable cylindrical body can thereby be discharged from the opened hole 510*a*.

Next, a not-shown actuator is driven to bring the brake 243 to an ON state, i.e., into abutment against the rotation shaft 52 of the bowl 5. During this operation, the bowl 5 is secured to the rotatably movable frame 24 and to the casing 4. In the state in which the bowl 5 is secured, the wing driving motor 73 is driven, and only the wing portion 6 is rotated in a predetermined direction (an anticlockwise direction in a plan view in the present embodiment). The solids accumulated in the bowl 5 are thereby scraped off by the wings 612 of the wing portion 6 and discharged to the outside from the hole 510*a* of the bowl shell 51. The discharged solids fall to the outside from the lower side of the casing 4 from which the cover 41 has been detached.

Therefore, in the vertical centrifugal separator 1 in the present embodiment, the solids produced during centrifugation processing and accumulated in the bowl 5 can be automatically discharged without detaching the bowl 5 from the casing 4. When the viscosity of the solids (cake) is high and the torque of the wing driving motor 73 becomes excessively high, the washing solution is jetted from the spray nozzle 616 and 617 before or while the wing portion 6 is rotated, so that the discharge of the solids can be facilitated. When the target material is the separated solution, the washing solution may be jetted in a similar manner to facilitate the discharge of the solids.

In other words, by the above-described operation of the vertical centrifugal separator 1, the solids are removed from the bowl 5 completely or as completely as possible. Therefore, the time, cost, and the like required to wash the inside of the bowl 5 after the above operation are significantly reduced. More specifically, the bowl 5 need not be detached from the casing 4. For some types of solutions to be processed or for the purpose of maintenance, the bowl 5 must be detached from the casing 4 to further wash the inside of the bowl 5. Even in such a case, the time and cost required to complete washing are significantly reduced. Therefore, the time and cost required to complete washing when, for example, a food or chemical is used as the solution to be processed are significantly reduced as compared to those in the conventional vertical centrifugal separator.

(CIP Mode)

A description will next be given of the procedure during washing of the bowl 5, the operation of the vertical centrifugal separator 1, and the like. First, the cover 41 provided with the feed tube 42 that has been detached before discharge is attached to the casing 4. Next, a not-shown actuator is driven to raise the lifter 211 from the position shown in FIG. 1. During this operation, the driving shaft of the low-speed driving motor 72 raised together with the lifter 211 is engaged with and connected to the lower-side driving shaft of the main driving motor 71.

Then the bowl 5 is rotated by the low-speed driving motor 72 at low rotation speed while the washing solution is urged and supplied to the feed tube 42 to wash the bowl 5. During washing, the rotation of the wing portion 6 is stopped, and the brake 243 is brought to an OFF (release) state, so that only the bowl 5 is rotated. The washing solution is thereby jetted from the nozzles 616 and 617 of the wing portion 6 at high pressure. The jetted washing solution then impinges strongly on the wings 612, and the washing solution impinging on the wings 612 is reflected and then impinges on the inner surface of the bowl 5, so that the inside of the rotatable cylindrical body is automatically washed. During washing, the remaining solids that have not been removed during the automatic discharge described above, particularly the remaining solids adhering to the wings 612 and the inner wall of the bowl 5, are well washed off by the physical and chemical actions of the washing solution urged and supplied. These solids are removed from the bowl 5 together with the washing solution and are discharged to the outside of the casing 4 from the drain port 411.

In the vertical centrifugal separator 1 provided with the above-described washing mechanism in the present embodiment, the time required to wash the inside of the bowl is significantly reduced as compared to that in a vertical centrifugal separator that uses a conventional water-sealed method, i.e., a method in which the washing solution is supplied to the inside of the bowl to wash the inside of the bowl while the bowl is rotated under water sealed conditions. More specifically, although it takes about 30 minutes to complete washing in the conventional vertical centrifugal separator using the water sealed method, the washing of the inside of the bowl can be completed in about 5 minutes in the present embodiment.

After completion of the washing operation, a not-shown actuator is driven to lower the lifter 211, and the connection between the driving shaft of the low-speed driving motor 72 and the lower-side driving shaft of the main driving motor 71 is thereby released.

(During Disassembling)

For the purpose of regular maintenance or for some types of solutions to be processed, the bowl 5 and the wing portion 6 must finally be detached from the casing 4, disassembled, and washed. The procedure of disassembling the bowl assembly, the operation of the vertical centrifugal separator 1 during disassembling, and the like will next be described with reference to FIG. 5.

Figure 5:
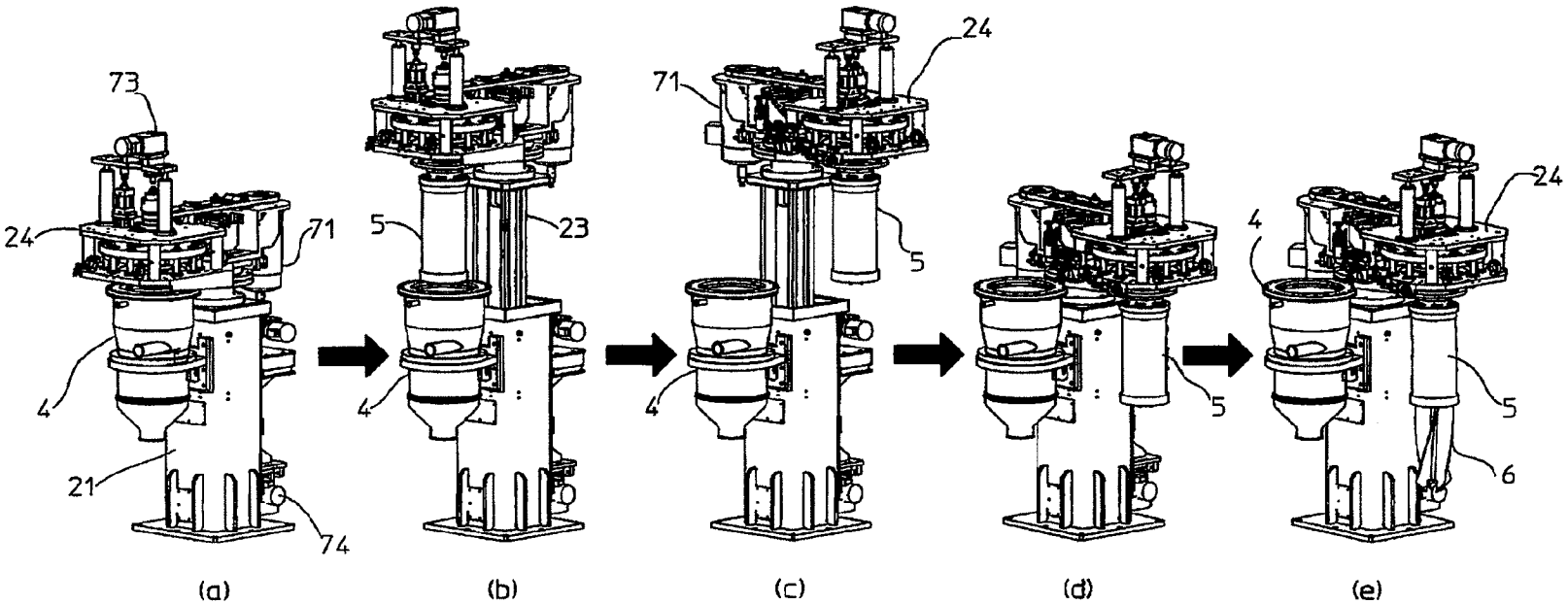
FIG. 5 is a series of diagrams illustrating the procedure of disassembling a bowl assembly, FIG. 5(*a*) showing the state during preparation for disassembling, FIG. 5(*b*) showing the state in which the bowl assembly has been pulled out of a casing, FIG. 5(*c*) showing the state in which the bowl assembly has been moved in a lateral direction from the state shown in FIG. 5(*b*), FIG. 5(*d*) showing the state in which the bowl assembly has been lowered from the state shown in FIG. 5(*c*), FIG. 5(*e*) showing the state in which the wing assembly has been pulled out from the state shown in FIG. 5(*e*).

First, in the state shown in FIG. 5(*a*), the bowl removing motor 74 is driven in a predetermined direction, and the rotation shaft 212 in the above-described raising-lowering mechanism is thereby rotated to raise the upward-downward movable frame 23 and the rotatably movable frame 24 integrally. During this operation, the bowl assembly composed of the wing portion 6 and the bowl 5 attached to the rotatably movable frame 24 is raised and pulled upward out of the casing 4, as shown in FIG. 5(*b*).

Next, in the state shown in FIG. 5(*b*), a not-shown actuator is driven to move the rotatably movable frame 24 rotation ally relative to the upward-downward movable frame 23 by a predetermined angle, or 90° in an anticlockwise direction in a plan view in the present embodiment. During this operation, the bowl assembly positioned above the casing 4 is separated from the casing 4 as shown in FIG. 5(*c*), so that no other members are present below the bowl assembly.

Then, in the state shown in FIG. 5(*c*), the bowl removing motor 74 is driven in the direction opposite to the direction during the raising operation. The upward-downward movable frame 23 and the rotatably movable frame 24 are thereby lowered integrally, and the level of the upper portion of the bowl assembly coincides with the level of the casing 4, as shown in FIG. 5(*d*). In the state shown in FIG. 5(*d*), the bowl bottom 510 is detached from the bowl shell 51, and the inner ring 63 is detached from the rotation shaft 62 of the wing portion 6. Then the wing portion 6 is pulled off downward, as shown in FIG. 5(*e*). Therefore, the wing portion 6 and the inner wall of the bowl 5 can be washed thereafter.

As described above, in the structure of the vertical centrifugal separator 1 of the present embodiment, the fixed frame 21 and the casing 4 are integrated, and the upward-downward movable frame 23 is disposed so as to be raised and lowered relative to the fixed frame 21. In addition, the rotatably movable frame 24 is disposed so as to be rotatable relative to the upward-downward movable frame 23, and the bowl 5 is disposed so as to be rotatable relative to the rotatably movable frame 24. When the upward-downward movable frame 23 is raised, the rotatably movable frame 24 and the bowl 5 are raised integrally to allow the bowl 5 to be pulled upward out of the casing 4. The rotational movement of the rotatably movable frame 24 allows the bowl 5 located above the casing 4 to be separated from the casing 4. Therefore, the bowl assembly can be simply and rapidly disassembled.

Figure 6:
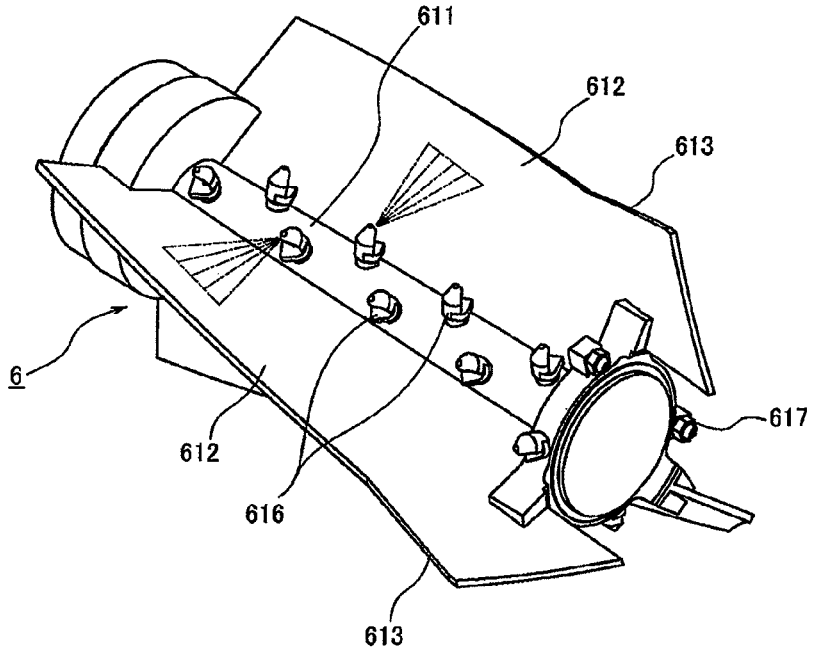
FIG. 6 is a diagram illustrating a modification of the wing portion.

In the embodiment described above, the washing mechanisms for washing the bowl 5 is configured to include the nozzles 615 (the horizontal spray nozzle 616 and the vertical spray nozzle 617) that are arranged such that the washing solution is jetted toward one side of each of the wings 612. An alternative embodiment may be configured such that the nozzles 615 (the horizontal spray nozzle 616 and/or the vertical spray nozzle 617) are arranged such that the washing solution is jetted toward both sides (both the front and rear sides) of each of the wings 612. In such a configuration, for example, additional horizontal spray nozzle 616 for washing adjacent wings may be disposed between the six horizontal spray nozzle 616 shown in FIG. 3(*a*). With this configuration, the time required to wash the inside of the bowl can be further reduced. FIG. 6 shows another example of the wing assembly 61. More specifically, the wing assembly 61 shown in FIG. 6 has a structure in which three wings 612 protrude from the shaft 611, and horizontal spray nozzle 616 that change their orientations alternately are disposed such that the washing solution is jetted toward both sides (both the front and rear sides) of each of the wings 612.

Second Embodiment

A second embodiment of the present invention will next be described in detail with reference the accompanying drawings. The configuration in the present embodiment is similar to that in the first embodiment except that a structure suitable for reducing the size of the apparatus and a structure allowing washing under water sealed conditions are provided. Therefore, in the structure of the vertical centrifugal separator 1 in the present embodiment, as in that in the first embodiment, stable high-speed rotation that gives a centrifugal force of about 20,000 G can be achieved. In addition, the centrifuged solids can be efficiently discharged, and washing can be performed efficiently.

Therefore, the same components as those in the vertical centrifugal separator 1 in the first embodiment are designated by the same reference numerals, and their detailed description is omitted. Components whose positions and the like are changed due to the change in the structure are considered the same as those in the vertical centrifugal separator 1 in the first embodiment when their functions and actions are the same as those in the first embodiment.

The structure suitable for reducing the size of the apparatus is configured such that the bowl 5 can be removed from the lower side of the casing 4. In the vertical centrifugal separator 1 in the first embodiment, the apparatus is automatically disassembled as shown in FIG. 5, and the bowl 5 is removed from the upper side of the casing 4. Therefore, a space with a length equal to or larger than the length of the bowl 5 must be provided on the upper side of the apparatus. The structure in the first embodiment that allows the bowl 5 to be automatically removed from the casing 4 is advantageous in that the load on the operator, for example, can be reduced, but the space occupied by the apparatus is large. When the apparatus is used in the fields of food and medicine, the apparatus is installed in, for example, a clean room, and only a limited space is allocated for the apparatus. Therefore, in some cases, a reduction in size of the apparatus is required.

Figure 7:
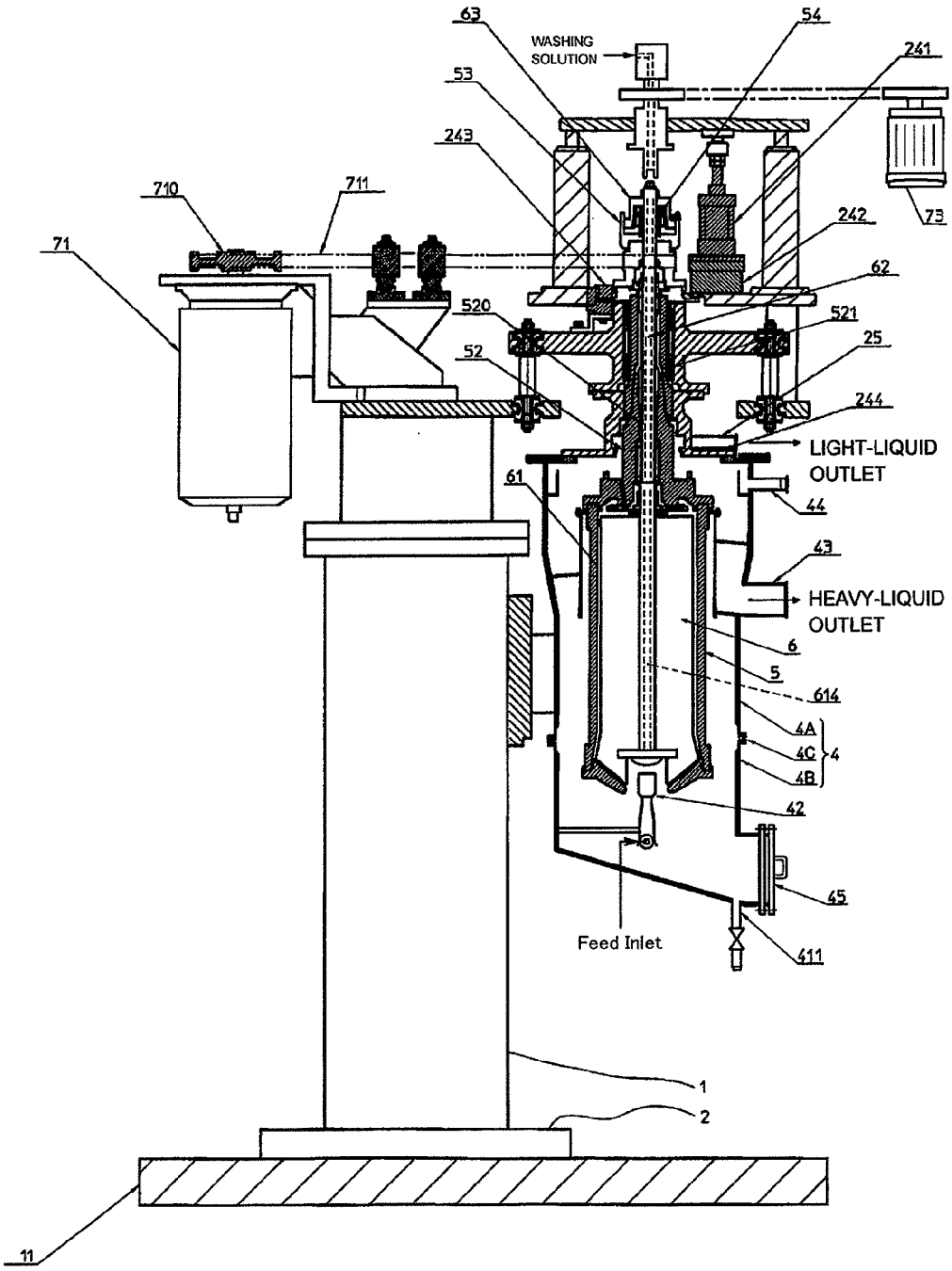
FIG. 7 is a partial cross sectional view illustrating the general outline of a vertical centrifugal separator to which a second embodiment of the present invention is applied.

Accordingly, in the structure in the second embodiment, the casing 4 is divided into an upper casing 4A and a lower casing 4B as shown in FIG. 7, and the upper and lower casings 4A and 4B are detachably connected at their connection portions 4C using securing means such as a clamp. Therefore, when the lower casing 4B is detached, the lower portion of the bowl 5 is exposed. When the operator, for example, pulls downward off the rotatable cylindrical body (i.e., the bowl 5 and the wing portion 6) together with the rotation shafts 52 and 62, the bowl 5 and the wing portion 6 can be detached. In the above structure, the virtual occupation space of the apparatus can be reduced as compared to that when the bowl 5 is lifted upward, and therefore the size of the apparatus can be reduced. In addition, the movable frame 22 for automatically removing the bowl 5 from the lower casing 4B and the driving mechanism for the movable frame 22, as exemplified in FIG. 1, can be omitted, and only the fixed frame 21 is required to be provided. The size of the apparatus is reduced accordingly, and the cost of the facility is reduced. When the apparatus is disassembled for maintenance, for example, the lower casing 4B is detached, and the upper casing 4A is detached from the connection part between the lower portion of main bearing housing 244 and the upper casing 4A. Then the wing portion 6 is detached together with the rotation shaft 62, and the bowl 5 can be thereby detached together with the rotation shaft 52.

The lower casing 4B in the present embodiment has a shape with a bottom inclined in one direction, and an openable-closable door 45 (such as a man-hole) is provided at the front end surface of the lower casing 4B. In such a case, when a predetermined amount of solids (cake) is accumulated in the bowl 5 during centrifugation, the wing portion 6 is driven by the wing driving motor 73 to discharge the solids from the bowl 5, and then centrifugation is continued or resumed after washing. When a certain amount of discharged materials (the solids and washing solution) is accumulated in the lower casing 4B during continuous centrifugation, the door 45 is opened to discharge the solids and the like from the casing 4. Such continuous centrifugation allows a reduction in the total processing time as compared to that when the solids are discharged from the casing 4 after each centrifugation operation.

In the vertical centrifugal separator 1 in the present embodiment, the structure suitable for reducing the size of the apparatus uses a bearing in the bearing mechanism 521 for rotatably supporting the rotation shaft 52 of the bowl 5 and employs a method of automatically injecting lubricating grease into the bearing. In this manner, for example, even when the diameter of the bowl 5 is reduced to reduce the size of the apparatus, high-speed rotation can be maintained.

More specifically, to achieve the centrifugal force using a bowl 5 with a reduced diameter, the rotation speed of the bowl 5 must be increased by an amount corresponding to the reduction in diameter. For example, to achieve a centrifugal force of about 20,000 G using a bowl 5 with a diameter of 14 inches, the rotation speed must be about 10,000 rpm. To achieve a centrifugal force of about 20,000 G using a bowl 5 with a diameter of 10 inches, the rotation speed must be about 12,000 rpm. However, the load on the bearing in the bearing mechanism 521 increases by an amount corresponding to the increase in the rotation speed of the bowl 5. In some bearings, such a rotation speed exceeds the permissible rotation speed in their specifications.

Figure 8:
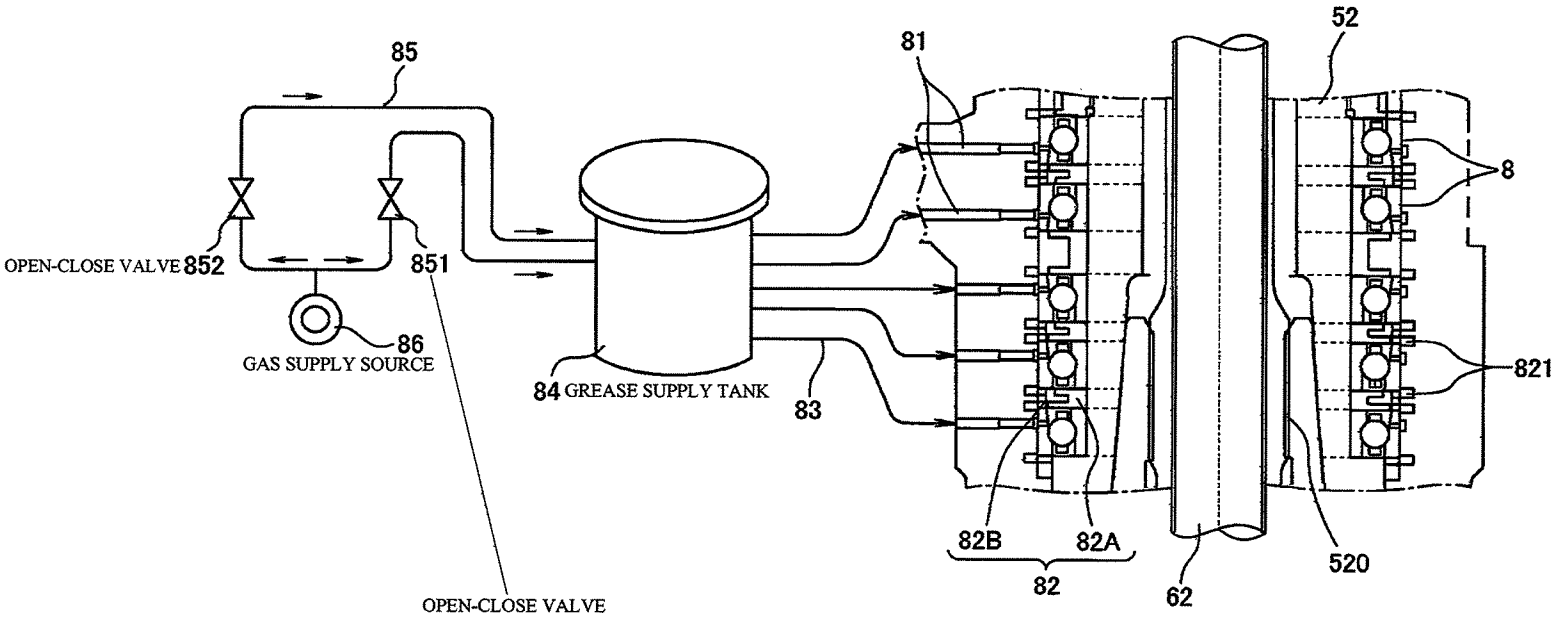
FIG. 8 is a diagram showing ball bearings for supporting the rotation shaft of a bowl and a piping system for supplying a lubricating grease.

Therefore, in the present embodiment, a plurality of ball bearings 8 are arranged in the axial direction of the rotation shaft 52, and an injection hole 81 for injecting lubricating grease is formed for each of the ball bearings 8, as shown in FIG. 8. A ring-shaped member (so-called spacer) 82 is disposed between adjacent bearings to form a reservoir space 821 for reserving the grease in the spacer 82. The reservoir spaces 821 formed in the spacers 82 are used to reserve excess grease discharged from the ball bearings 8 when additional grease is fed. Each spacer 82 includes an inner spacer 82A and an outer spacer 82B fitted to each other, and a groove portion (not shown) for discharging the grease from the inside of a bearing to the reservoir space 821 is formed in the outer spacer 82B. This groove portion is formed in consideration of the direction of the bearing and other factors so that the grease once discharged to the reservoir space 821 is prevented from re-entering the inside of the bearing. By preventing unnecessary grease from re-entering the inside of the bearing as described above, an increase in temperature of the bearing can be prevented. Grease supply passages 83 such as pipes or tubes are connected to the injection holes 81 of the ball bearings 8, and a grease supply tank 84 is connected to the base end side of the grease supply passages 83. Five ball bearings 8 are disposed along the rotation shaft 52 in FIG. 7. However, no limitation is imposed on the number of ball bearings 8.

A gas supply passage 85 such as a pipe or tube for supplying a gas (such as air or nitrogen) for pressurization and extrusion of the grease is further connected to the grease supply tank 84, and a gas supply source 86 such as a compressor or a tank is connected to the base end side of the gas supply passage 85. The gas supply passage 85 includes two lines for tank pressurization and for grease extrusion, and open-close valves 851 and 852 are provided in these two lines, respectively. Therefore, when the open-close valve 852 is opened to increase the pressure inside the grease supply tank 84 and then the open-close valve 851 is instantaneously opened to drive like a piston, the grease is extruded into the grease supply passages 83, and substantially equal amounts of grease are fed into the respective ball bearings 8. The amount of grease injected can be controlled by the opening time of the open-close valve 851 and the pressure for pressurization. The opening timing of the open-close valve 851 can be controlled by, for example, a sequence program installed in a not-shown controller.

In the above configuration, the ball bearings 8 (except for the reservoir spaces 821) are filled with the required amount of grease in advance, and centrifugation is performed in the procedure described above. In this manner, the apparatus is maintenance free for more than a year. During this period, a predetermined amount of grease is fed at regular time intervals, and excess (unnecessary) grease is reserved in the reservoir spaces 821 until the apparatus is disassembled at the next maintenance. In a preferred example, about 0.02 cc of grease is fed into each of the ball bearings 8 once a day just after the start of operation, and the grease accumulated in the spaces is removed when maintenance is performed in a period of one year.

When the apparatus is used for a food or medicine, a grease is selected as the lubricant for the ball bearings 8 because impurities mixed may cause problems. However, when a grease is used, it is not possible to check, after the ball bearings 8 are filled with a predetermined amount of grease and the apparatus is assembled, whether or not the required amount of grease remains in the ball bearings 8 unless the apparatus is subsequently disassembled. Therefore, a problem arises as to whether or not seizing of the rotation shaft 52 can be prevented when a bowl 5 with a reduced diameter is used and the rotation speed is increased. In the configuration of this embodiment, a small amount of grease is regularly injected, and the excess grease is discharged and prevented from re-entry. In this manner, the amount of grease in the ball bearings 8 can be optimally maintained, and an increase in temperature of the bearings during supply of the grease can be prevented.

Therefore, since the seizing problem and the like can be prevented even at higher rotation speed, the diameter of the bowl 5 can be reduced, and the size of the apparatus can thereby be reduced. This is also advantageous for the operator because the labor for maintenance is reduced. Of course, a higher centrifugal force can be obtained by increasing the rotation speed of the bowl 5 without changing the diameter of the bowl 5. The structure of the ball bearings 8 shown in FIG. 8 may be used for the vertical centrifugal separator 1 in the first embodiment shown in FIG. 1.

The vertical centrifugal separator 1 in the present embodiment has a structure suitable for washing under water sealed conditions, in addition to the structure suitable for reducing the size of the apparatus. In this structure, washing under water sealed conditions can be performed in addition to washing using the spray nozzle 616 and 617 described above. This allows the casing 4 and the rotatable cylindrical body (the bowl 5 and the wing portion 6) to be kept clean in a more reliable manner. The vertical centrifugal separator 1 of the present embodiment is configured such that washing under water sealed conditions can be performed before, after, or simultaneously with the above-described washing using the spray nozzle 616 and 617.

Figure 9:
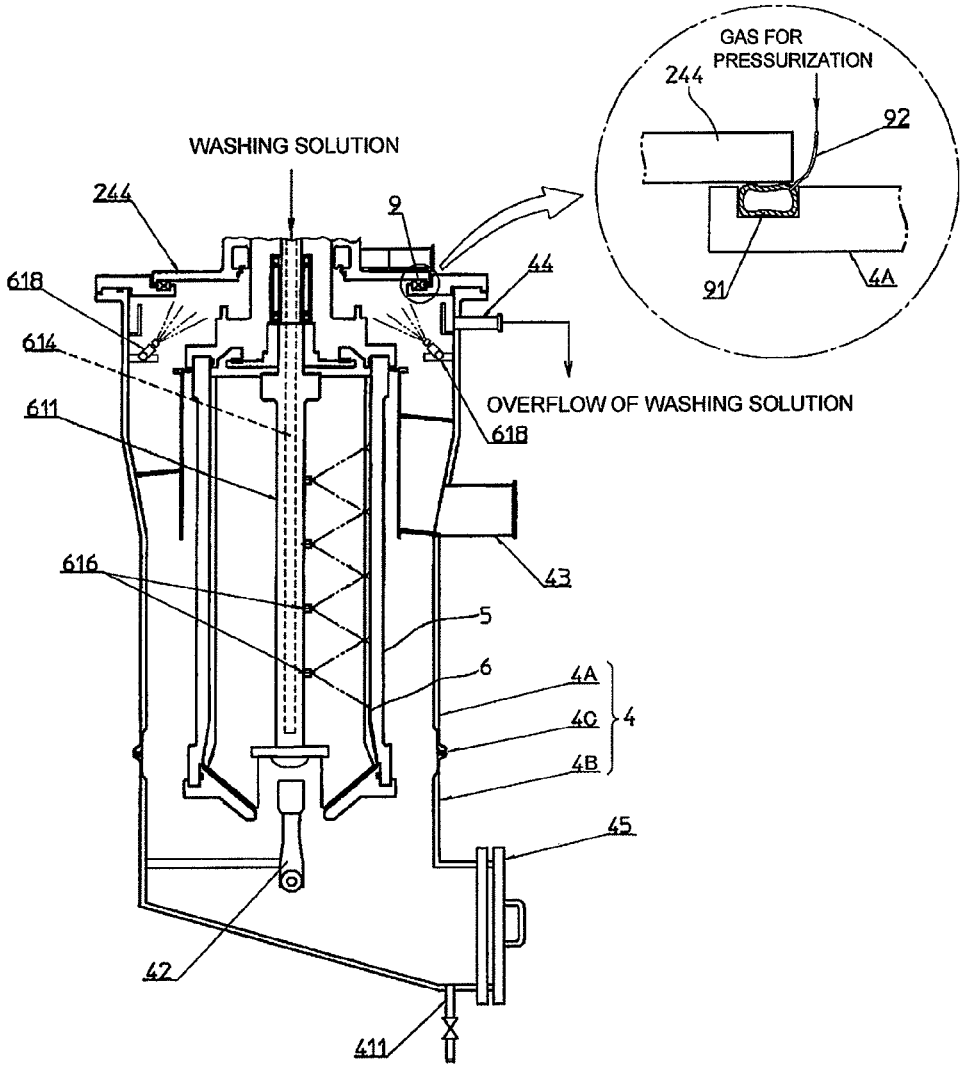
FIG. 9 is a diagram illustrating the sealing mechanism of a casing and the manner of washing under water sealed conditions.

As shown in FIG. 7 or 9, the wing assembly 61 shown in FIG. 6 has been installed in the vertical centrifugal separator 1 of the present embodiment. In contrast to the first embodiment in which the washing solution is supplied through the feed tube 42 disposed on the lower side, the inner tube 614 used as the supply passage of the washing solution is extended to the upper end of the shaft 611 to supply the washing solution from the upper side. Therefore, an inner tube used as the supply passage of the washing solution is also formed in the driving shaft rotated by the wing driving motor 73, and the washing solution is supplied after the shaft 611 and the driving shaft are coupled to each other by the first cylinder 241. In the present embodiment, the position of the wing driving motor 73 is changed, and the rotation shaft is driven by a couple gears.

When operating in dipping washing, the casing 4 must be hermetic. Generally, a known sealing material such as an O-ring or gasket can be used as the sealing material disposed at each of the connection portions/coupled portions of the casing 4. No limitation is imposed on the type of the sealing material, so long as sufficient sealing properties are ensured. However, for example, when the number of parts increases, sufficient sealing properties may not be ensured due to the influence of production errors and other factors. Therefore, a sealing member 91 formed into a tubular shape using an elastic material such as rubber is used as a sealing material 9 that is disposed at a position at which the sealing properties are of particular importance, for example, at the connection portion between the lower portion of main bearing housing 244 of the casing 4 and the upper casing 4A shown in FIG. 9. In addition, a tube 92 for urging and supplying a fluid for pressurization (such as air or nitrogen) to the inside of the sealing member 91 is connected, and a fluid source (not shown) such as a compressor or a steel bottle is connected to the base end of the tube 92. An open-close valve (not shown) is provided at a midway of the tube 92. For example, the open-close valve is opened at all time to urge and supply the fluid for pressurization to the sealing member 91. The sealing member 91 is thereby expanded in the groove portion, and the gap in the connection portion is eliminated and sealed.

With the hermeticity of the casing 4 being ensured as described above, outlets such as the heavy-liquid discharge port 43 are closed, and the washing solution is jetted from, for example, the spray nozzle 616 and 617 as described above. The inner surface of the bowl 5 and the wing portion 6 are thereby washed, and the washing solution is accumulated in the casing 4. The washing under water sealed conditions is continued until the washing solution is accumulated to a level at which the washing solution is discharged from the outlet 44 for an overflow. In this manner, particularly, the outer surface of the bowl 5 and the inner surface of the casing 4 that cannot be sufficiently washed using the spray nozzle 616 and 617 can be washed. In this case, a valve may be provided at the outlet of the outlet 44 to control the discharged amount or the supply pressure of the washing solution may be increased so that the washing solution reaches the inner upper surface of the casing 4. To wash the inner upper surface and upper corners of the casing 4 that are likely to become dead spaces, spray nozzle 618, for example, may be disposed at positions shown in FIG. 9.

In the vertical centrifugal separator 1 of the present embodiment, the low-speed driving motor 72 and the lifter 211 in the first embodiment are omitted, and the bowl is rotated during washing by the main driving motor 71. More specifically, this embodiment includes two motors 71 and 73 for driving the main body and driving the wings.

While the present invention has been described in detail in conjunction with specific embodiments, it is apparent to persons of ordinary knowledge in this technological field that various substitutions, modifications, changes, and the like to the forms and details can be made without departing from the spirit and scope of the invention that are defined in the description of claims. Therefore, the scope of the invention is not limited to the above-described embodiments and the accompanying drawings but should be defined by the claims and their equivalents.

DESCRIPTION OF REFERENCE NUMERALS

1 vertical centrifugal separator
4 casing

4A upper casing
4B lower casing
5 bowl
511 tapered portion of the bowl (engagement portion)
53 index ring (first ring-shaped member)
533, 534, 535 protruding portion
54 coil spring (urging member)
6 wing portion (discharge assembly)
612 wing assembly
613 tapered portion (engagement portion)
616 horizontal spray nozzle
617 vertical speading nozzle
63 inner ring (second ring-shaped member)
71 main driving motor
72 low-speed driving motor
73 wing driving motor
8 ball bearing
81 grease feed hole
82 spacer
821 grease reservoir space

The invention claimed is:

1. A vertical centrifugal separator, comprising:

a casing;

a bowl serving as a rotatable cylindrical body rotatably housed in the casing, the bowl separating a solution to be processed which is supplied to an interior of the bowl into a liquid and a solid by an action of centrifugal force, the liquid and the solid being discharged from respective discharge portions; and a discharge assembly rotatably housed in the bowl, the discharge assembly discharging the solid from the bowl, wherein the bowl and the discharge assembly form a single-end supported structure in which a first axial end of each of the bowl and the discharge assembly is rotatably supported and a second axial end of each of the bowl and the discharge assembly is a free end, wherein each of the bowl and the discharge assembly has an engagement portion that is engaged or disengaged when the bowl and the discharge assembly are moved relative to each other in an axial direction and a position adjustment mechanism which adjusts a phase between the bowl and the discharge assembly relative to a rotation axis of the bowl and the discharge assembly to at least a single relative position so that the bowl and the discharge assembly are positioned in consideration of a dynamic balance when the bowl and the discharge assembly are integratively rotated, wherein, when the solution to be processed is separated by the action of centrifugal force, the bowl and the discharge assembly integrally rotate in an engagement state in which the phase adjusted by the position adjustment mechanism is held, and the bowl and the discharge assembly are allowed to rotate relative to each other when the engagement state is released, wherein the bowl includes a bowl shell having a substantially cylindrical tank shape, to which the solution to be processed is supplied, and a hollow rotation shaft integrated with an upper portion of the bowl shell, wherein the discharge assembly includes a wing assembly having a plurality of wings formed integrally with the wing assembly and contained in the bowl shell and a rotation shaft protruding upward from the wing assembly and rotatably disposed in the hollow rotation shaft of the bowl, and wherein the engagement portion of the bowl is disposed on a lower side of the bowl and has a tapered portion that is tapered such that an inner diameter of the bowl increases in a downward direction, and the engagement portion of the discharge assembly is disposed on a lower side of the discharge assembly and has a tapered portion that is tapered such that a width of the discharge assembly increases in a downward direction; and when the discharge assembly moves upward relative to the bowl, the engagement state is established in which the bowl is driven to rotate and rotates integrally with the discharge assembly.

2. The vertical centrifugal separator according to claim 1, wherein the bowl and the discharge assembly rotate integrally at a high speed while the centrifugal force is generated, the centrifugal force being of about 20,000 G.

3. The vertical centrifugal separator according to claim 1, wherein the position adjustment mechanism includes a first ring-shaped member disposed on the hollow rotation shaft of the bowl and a second ring-shaped member disposed on the rotation shaft of the discharge assembly and faces the first ring-shaped member, and a groove portion is formed in one of the first ring-shaped member and the second ring-shaped member and a protruding portion fittable to the groove portion is formed in the other one of the first ring-shaped member and the second ring-shaped member.

4. The vertical centrifugal separator according to claim 3, wherein:

the groove portion includes a plurality of groove portions and the protruding portion includes a plurality of protruding portions; the plurality of groove portions and the plurality of protruding portions are disposed at positions at which each of the protruding portions is fitted to a corresponding one of the groove portions when the hollow rotation shaft of the bowl and the rotation shaft of the discharge assembly are rotated relative to each other; and the groove portions and the protruding portions are disposed at positions arranged such that angles between the positions with respect to a center axis of the hollow rotation shaft of the bowl and the rotation shaft of the discharge assembly are different from each other.

5. The vertical centrifugal separator according to claim 1, comprising urging means for urging the discharge assembly in one direction, wherein the engagement portion of the bowl and the engagement portion of the discharge assembly bring the bowl and the discharge assembly into the engagement state by being urged by the urging means after completion of a position adjustment by the position adjustment mechanism.

6. The vertical centrifugal separator according to claim 1, wherein the bowl has a bearing mechanism that includes a plurality of ball bearings arranged in the axial direction, injection holes for lubricating grease that are formed in the ball bearings, and spacers that form spaces for reserving excess grease discharged from the ball bearings when the lubricating grease is fed into the ball bearings.

7. The vertical centrifugal separator according to claim 1, comprising a nozzle for supplying a washing solution to the casing and a sealing mechanism for hermetically sealing the casing so that the bowl and the discharge assembly are washed in the casing under a water sealed condition, and wherein the sealing mechanism includes: a sealing member that is disposed at a connection portion of the casing and is expanded to improve sealing properties when a fluid for pressurization is urged and supplied to an interior of the sealing member; and means for supplying the fluid to the sealing member.

8. The vertical centrifugal separator according to claim 1, wherein the discharge assembly includes a washing mechanism that includes: a hollow shaft disposed in a portion contained in the bowl; and a spray nozzle disposed so as to be in communication with the hollow shaft, so that the washing mechanism washes the discharge assembly and the interior of the bowl by jetting a washing solution urged and supplied from one end of the hollow shaft outward from the spray nozzle.

9. The vertical centrifugal separator according to claim 8, wherein the spray nozzle is disposed at a position that allows the washing solution urged and supplied to be jetted toward the discharge assembly and allows the washing solution to impinge on an inner wall of the bowl after the washing solution is reflected from the discharge assembly.

10. The vertical centrifugal separator according to claim 1, comprising a disassembling mechanism that includes:

a fixed frame integrated with the casing, an upward-downward movable frame that is movable upward and downward relative to the fixed frame, and a rotationally movable frame to which the bowl is attached, to which the discharge assembly is detachably attached, and which is disposed so as to be rotationally movable relative to the upward-downward movable frame, the disassembling mechanism being configured to cause the upward-downward movable frame to be raised to pull the bowl and the discharge assembly out of the casing, and to cause the rotationally movable frame to rotationally move and then cause the upward-downward movable frame to be lowered, so that the discharge assembly is separated from the rotationally movable frame.

* * * * *